US008646627B2

(12) United States Patent
Bass et al.

(10) Patent No.: US 8,646,627 B2
(45) Date of Patent: Feb. 11, 2014

(54) SLIDER PANEL FOR PRODUCT DISPLAY

(75) Inventors: Michael A. Bass, Chagrin Falls, OH (US); Jamie B. Peltz, Orange Village, OH (US); Kevin M. Shepard, Davenport, IA (US); Thomas M. Gordon, Medina, OH (US); Raymond A. Phelps, North Ridgeville, OH (US); Richard B. Young, Shelby, OH (US)

(73) Assignee: Jandorf Specialty Hardware, Northfield, OH (US)

( * ) Notice: Subject to any disclaimer, the term of this patent is extended or adjusted under 35 U.S.C. 154(b) by 420 days.

(21) Appl. No.: 12/963,776

(22) Filed: Dec. 9, 2010

(65) Prior Publication Data

US 2011/0315644 A1 Dec. 29, 2011

Related U.S. Application Data

(60) Provisional application No. 61/286,527, filed on Dec. 15, 2009.

(51) Int. Cl.
*A47F 5/00* (2006.01)
*A47F 5/08* (2006.01)

(52) U.S. Cl.
USPC ..... 211/162; 211/94.01

(58) Field of Classification Search
USPC ..... 211/162, 106.01, 46, 45, 47, 48, 94.01, 211/94.02, 94.03, 54.1, 28, 57.1, 59.1, 211/49.1; 40/657, 649; 49/409, 410, 411
See application file for complete search history.

(56) References Cited

U.S. PATENT DOCUMENTS

| | | | | | |
|---|---|---|---|---|---|
| 1,230,051 | A | * | 6/1917 | Stern | 211/46 |
| 2,098,828 | A | * | 11/1937 | Ludwick | 211/34 |
| 2,608,012 | A | * | 8/1952 | Jackson | 40/124.2 |
| 2,992,743 | A | * | 7/1961 | Wing | 108/48 |
| 3,360,136 | A | * | 12/1967 | Ain | 211/162 |
| 3,517,623 | A | * | 6/1970 | Sobel et al. | 108/187 |
| 3,750,893 | A | | 8/1973 | Kempler | |
| 3,883,004 | A | | 5/1975 | Slaga | |
| 3,973,678 | A | | 8/1976 | Nesbitt | |
| 4,000,573 | A | * | 1/1977 | Cohen | 40/620 |
| 4,155,459 | A | * | 5/1979 | Marschak | 211/49.1 |
| 4,171,052 | A | | 10/1979 | Winn | |
| 4,869,376 | A | | 9/1989 | Valiulis et al. | |
| 4,898,283 | A | | 2/1990 | Kingsford | |
| 4,982,852 | A | * | 1/1991 | Johansen | 211/162 |
| 5,139,155 | A | * | 8/1992 | Laxson | 211/169 |
| 5,154,305 | A | * | 10/1992 | Whitney | 211/162 |
| 5,357,701 | A | * | 10/1994 | Grate | 40/618 |
| 5,429,430 | A | | 7/1995 | Johnson | |

(Continued)

*Primary Examiner* — Jonathan Liu
*Assistant Examiner* — Patrick Hawn

(57) ABSTRACT

An apparatus includes a display structure that supports products in a display area within reach of a customer location. The apparatus further includes a panel structure supported for movement along upper and lower tracks. The panel structure has a transparent viewing section and indicia relating to the products, but is not configured to support any products itself. The panel structure also has horizontally opposite side edges spaced apart at a width that is less than the width of the display area. A frame structure supports the upper and lower tracks at locations that provide the panel structure with a path of movement interposed between the customer location and the display area. The path of movement includes positions in which the display area can be reached from the customer location past either of the opposite side edges of the panel structure.

14 Claims, 4 Drawing Sheets

(56) References Cited

U.S. PATENT DOCUMENTS

| | | | | |
|---|---|---|---|---|
| 5,526,941 | A * | 6/1996 | Ford | 211/59.1 |
| 5,675,946 | A * | 10/1997 | Verbeek et al. | 52/205 |
| 6,299,002 | B1 * | 10/2001 | Garnier | 211/162 |
| 6,491,172 | B2 * | 12/2002 | Chance et al. | 211/87.01 |
| 2002/0011456 | A1 * | 1/2002 | Hatami | 211/46 |
| 2005/0098518 | A1 * | 5/2005 | Shea | 211/87.01 |
| 2005/0236347 | A1 * | 10/2005 | Cole et al. | 211/94.01 |
| 2006/0213850 | A1 * | 9/2006 | VanCalbergh et al. | 211/94.01 |
| 2008/0251479 | A1 * | 10/2008 | Arradondo et al. | 211/85.3 |

* cited by examiner

SLIDER PANEL FOR PRODUCT DISPLAY

RELATED APPLICATIONS

This application claims the benefit of provisional U.S. patent application 61/286,527, filed Dec. 15, 2009, which is incorporated by reference.

TECHNICAL FIELD

This technology relates to sliding panels, and particularly relates to a sliding panel for use with a display of products offered for sale.

BACKGROUND

Products offered for sale are often displayed on hooks that are fitted into holes in a pegboard. In some cases, multiple pegboards are arranged front-to-back, and are supported to slide from side to side to provide access to the front of each pegboard.

SUMMARY OF THE INVENTION

A preferred embodiment of the invention includes a display structure that supports products in a display area within reach of a customer location. The preferred embodiment further includes a panel structure supported for movement along upper and lower tracks. The panel structure has indicia relating to the products, but is not configured to support any products itself. The panel structure also has horizontally opposite side edges spaced apart at a width that is less than the width of the display area.

The preferred embodiment also includes a frame structure that supports the upper and lower tracks at locations providing the panel structure with a path of movement interposed between the customer location and the display area. The path of movement includes positions in which the display area can be reached from the customer location past either of the opposite side edges of the panel structure.

Summarized differently, a preferred embodiment of the invention includes a horizontal upper track, a horizontal lower track, and a panel structure supported for movement along the upper and lower tracks. The panel structure has indicia relating to products on display. An upper frame structure supports the upper track at a location providing the panel structure with a path of movement interposed between the customer location and the products on display. A lower frame structure, which preferably supports additional products, is shiftable vertically relative to the panel structure throughout a range of selectable positions below the upper frame structure. The lower track is mounted on the lower frame structure to be shiftable vertically with the lower frame structure.

Summarized more broadly, the invention provides an apparatus including a first track, a panel structure linked to the first track for movement along the first track, and a second track that is spaced from the first track. The second track is configured to engage the panel structure in a condition to guide it along the second track simultaneously with movement along the first track. The second track is further configured to be shifted relative to the panel structure in directions toward and away from the first track while remaining in the engaged condition.

DETAILED DESCRIPTION

Figure 1:
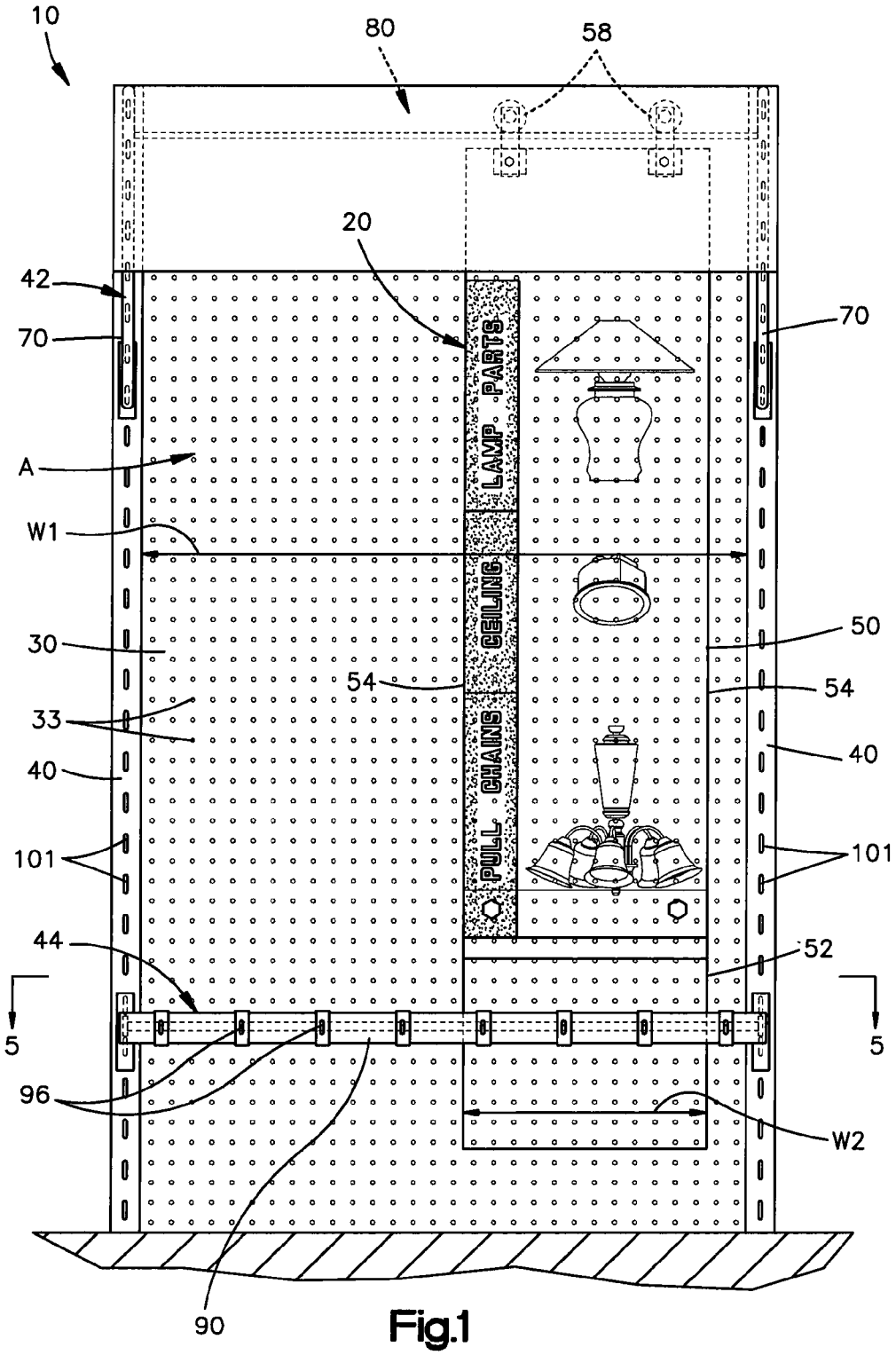
FIG. 1 a front view of a product display assembly.

The apparatus 10 shown in the drawings is a preferred embodiment of the invention, with parts that are examples of the elements recited in the claims. The following description thus includes examples of how a person of ordinary skill in the art can make and use the claimed invention. It is presented here to meet the requirements of enablement and best mode without imposing limitations that are not recited in the claims.

Figure 2:
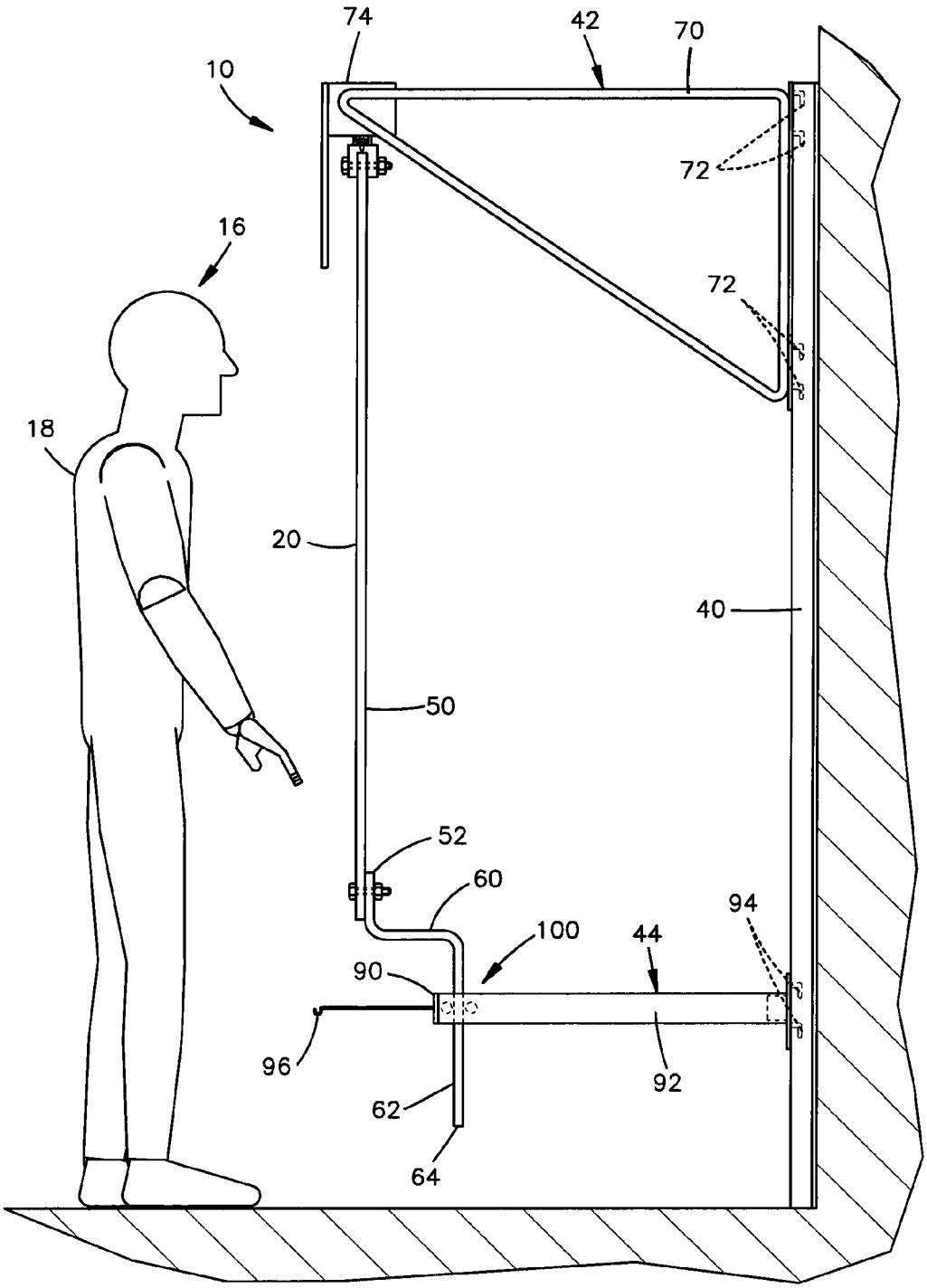
FIG. 2 is a side view of the assembly of FIG. 1.

As shown in FIGS. 1 and 2, the illustrated apparatus 10 in this particular example is a display assembly for products such as hardware products. The products, which in this example could include lamp parts, would be displayed within reach of a location 16 (FIG. 2) at which a customer 18 would stand facing the apparatus 10. A slider 20 is supported in front of the customer location 16, and has informational and educational images and text. The customer 18 can identify individual products by the information provided on the slider 20, and can move the slider 20 back and forth across the front of the apparatus 10 to reach the displayed products from either side of the slider 20.

The apparatus 10 further includes a pegboard 30 with holes 33 for product display hooks, baskets, and the like. Individual products, such as lamp harps and small packages for sockets or other hardware items, can be arranged on the pegboard 30 in any suitable array for presentation to the customer 18. The array of holes 33 in the pegboard 30 defines a product display area A with a width W1, as viewed from the front at the customer location 16.

A pair of slotted vertical rails 40, known as gondola uprights, are located at the opposite side edges of the pegboard 30. Upper and lower frame structures 42 and 44 are supported on the uprights 40, and project forward toward the customer location 16. The slider 20 is oriented vertically between the upper and lower frame structures 42 and 44 at the front of the apparatus 10.

In the given example, the slider 20 is a vertically elongated, rectangular panel structure with upper and lower panel sections 50 and 52. The panel sections 50 and 52 together define parallel opposite side edges 54 that provide the slider 20 with a uniform width W2 throughout its full height. The width W2 of the slider 20 is substantially less than the width W1 of the product display area A so that a customer 18 can move the slider 20 back and forth between positions in which products on the pegboard 30 can be reached past either side edge 54 of the slider 20.

Figure 3:
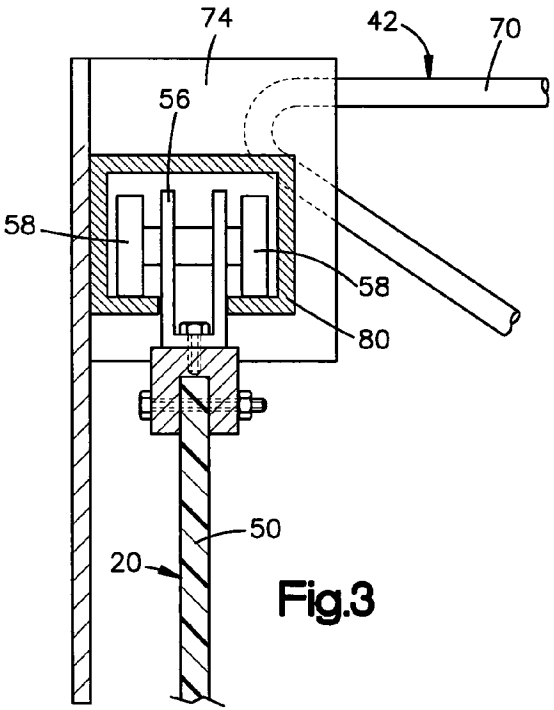
FIG. 3 is an enlarged, partial side view of parts shown in FIGS. 1 and 2.
Figure 5:
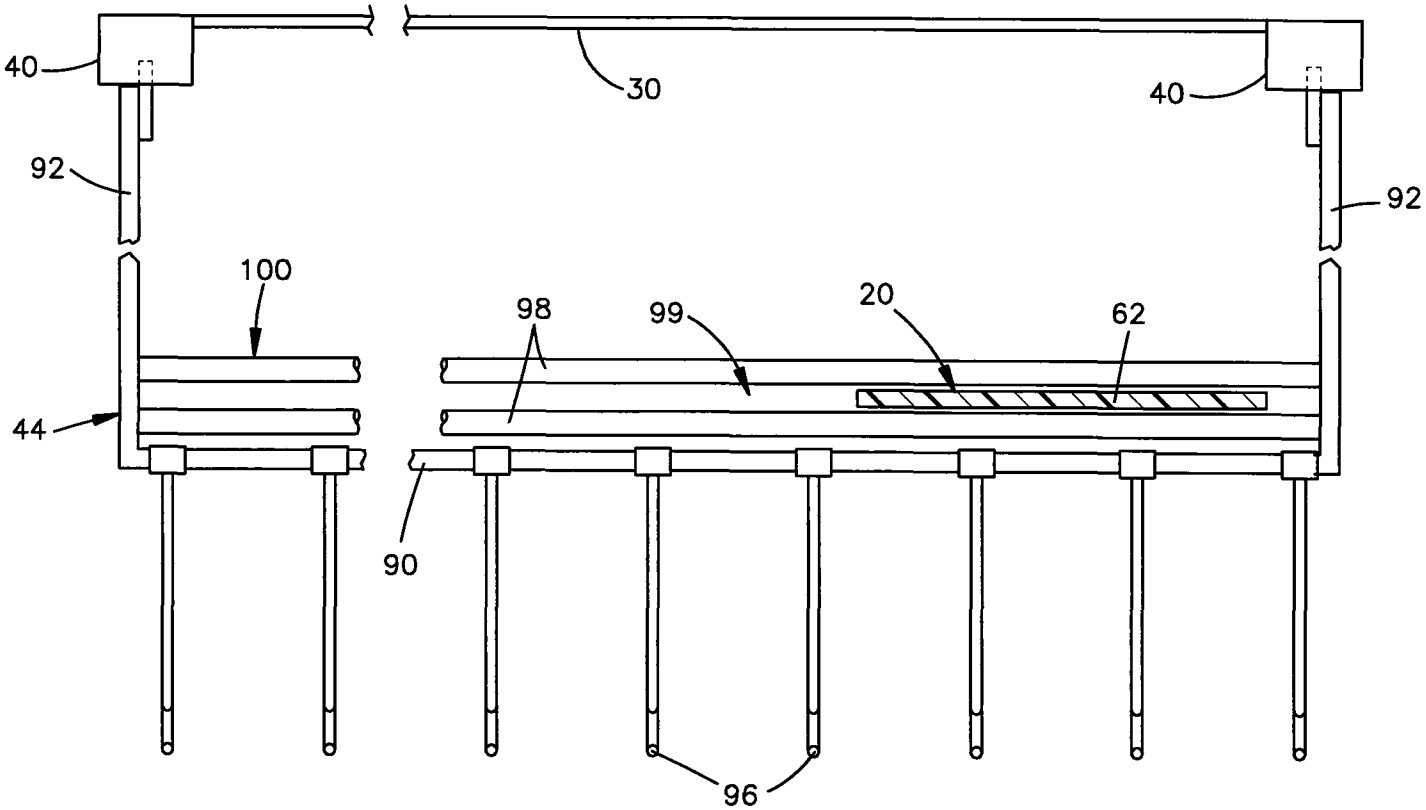
FIG. 5 is a top view taken on line 5-5 of FIG. 1.

Both panel sections 50 and 52 in the given example are rigid and transparent, and are preferably formed of clear plastic. The upper panel section 50 is longer than the lower panel section 52, and bears product information including images and tinted sections with text describing the identity and locations of individual products to be displayed on the pegboard 30. As shown in FIG. 3, a runner channel 56 with wheels 58 is fastened to the top of the upper panel section 50.

Figure 4:
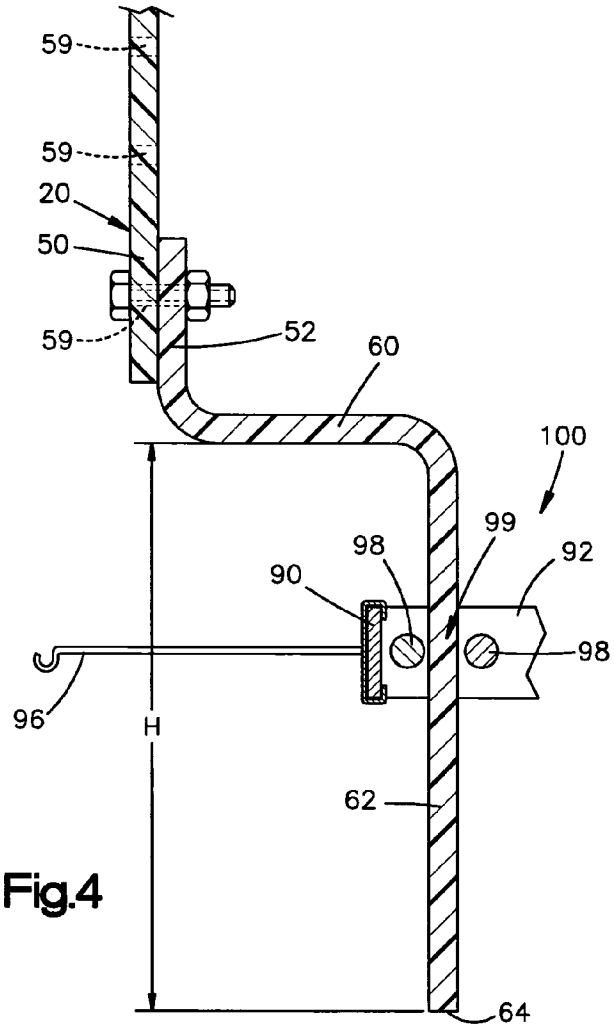
FIG. 4 is an enlarged, partial side view of other parts shown in FIGS. 1 and 2.

The lower panel section 52 is fastened to the bottom of the upper panel section 50. Vertically spaced apertures 59 (FIG. 4) enable the lower section 52 to be installed on the upper section 50 in any one of a range of corresponding vertical positions. A horizontal portion 60 of the lower section 52 projects rearward from the upper section 50, and a vertical portion 62 projects downward from the horizontal portion 60. The vertical portion 62 has a free lower end 64 and a height H.

Referring again to FIG. 2, the upper frame structure 42 includes a pair of generally triangular side braces 70, one of which is shown in the drawing. Each side brace 70 has gondola hooks 72 at its inner end for mounting on an upright 40 at any suitable height selected by the installer. Each side brace 70 also has a stopper plate 74 at its outer end.

As shown in FIG. 3, an upper track 80 extends horizontally across the upper frame structure 42 between the stopper plates 74. The wheeled runner channel 56 at the top of the slider 20 is coupled with the upper track 80 to be freely movable horizontally along the upper track 80 between the stopper plates 74. This provides a corresponding path of movement for the slider 20. In the preferred embodiment, the runner channel 56 is captured within the upper track 80 to block removal of the slider 20 vertically from the upper track 80.

The lower frame structure 44 includes a front bar 90 and two side bars 92 with gondola hooks 94 at their inner ends. Product display hooks 96 project from the front bar 90 forward past the slider 20 within reach of the customer location 16. A pair of rails 98 are located closely behind the front bar 90, and extend across the lower frame structure 44 between the side bars 92. The rails 98 are parallel and spaced apart from each other to define a slot 99 that likewise extends across the lower frame structure 44 between the side bars 92. The lower end 64 of the slider 20 is freely movable into and through the slot 99 upon movement of the lower frame structure 44 upward into the condition of FIG. 4. In that condition, the vertical portion 62 of the lower panel section 52 reaches vertically through the slot 99, and is freely movable horizontally along the length of the slot 99. The rails 98 thus define a lower track 100 for guiding the slider 20 to move horizontally across the lower frame structure 44 simultaneously with movement along the upper track 80 on the upper frame structure 42.

When products are mounted on the display hooks 96 on the lower frame structure 44, it may be desirable to shift the lower frame structure 44 vertically to accommodate the size of those products and their relationship to an array of products on the pegboard 30. An installer will then release the hooks 94 from the uprights 40, move the lower frame structure 44 vertically throughout a range of positions defined by the slots 101 in the uprights 40, and reinstall the lower frame structure 44 in another selected position.

The invention provides a vertical range of movement through which the installer can shift the lower frame structure 44 in the foregoing manner without also shifting the upper frame structure 42 or the slider 20, and without removing the slider 20 from guided engagement with the lower track 100. That range of movement corresponds to the height H at the bottom of the slider 20. Specifically, the vertical portion 62 of the lower panel section 52 is freely moveable vertically relative to the lower track 100, and remains within the slot 99, when the lower frame structure 44 is shifted vertically throughout the height H.

This written description sets forth the best mode of the invention, and describes the invention so as to enable a person of ordinary skill in the art to make and use the invention, by presenting examples of the elements recited in the claims. The patentable scope of the invention is defined by the claims, and may include other examples that occur to those skilled in the art. Such other examples are intended to be within the scope of the claims if they have elements that do not differ from the literal language of the claims, or if they have equivalent elements with insubstantial differences from the literal language of the claims.

The invention claimed is:

1. An apparatus comprising:

a horizontal upper track;

a panel structure linked to the upper track for movement along the upper track;

a horizontal lower track configured to be shifted relative to the panel structure throughout a vertical range of selectable positions in which the lower track engages the panel structure in a condition to guide the panel structure along the lower track simultaneously with movement along the upper track; and a support structure configured to releasably retain the lower track in each of the selectable positions;

wherein the lower track is configured to remain in the engaged condition when moving relative to the panel structure throughout the vertical range of selectable positions;

wherein the panel structure has an upper section configured to depend from the upper track and a lower section configured to engage the lower track at a location spaced horizontally from the upper section when the upper section is vertical.

2. An apparatus as defined in claim 1 wherein the panel structure is linked with the upper track in a configuration that blocks removal of the panel structure vertically from the upper track.

3. An apparatus as defined in claim 1 wherein the panel structure has a transparent viewing section.

4. An apparatus comprising:

a horizontal upper track;

a panel structure linked to the upper track for movement along the upper track;

a horizontal lower track configured to be shifted relative to the panel structure throughout a vertical range of selectable positions in which the lower track engages the panel structure in a condition to guide the panel structure along the lower track simultaneously with movement along the upper track; and a support structure configured to releasably retain the lower track in each of the selectable positions;

wherein the lower track is configured to remain in the engaged condition when moving relative to the panel structure throughout the vertical range of selectable positions;

wherein the panel structure has a free end that is movable relative to the lower track vertically through the lower track upon movement of the lower track into and out of the engaged condition.

5. An apparatus for use with products on display within reach of a customer location, comprising:

a horizontal upper track;

a horizontal lower track;

a panel structure supported for movement along the upper and lower tracks, the panel structure having indicia relating to products;

an upper frame structure configured to support the upper track at a location providing the panel structure with a path of movement interposed between the customer location and the products on display; and a lower frame structure configured to be shifted vertically relative to the panel structure throughout a range of selectable positions below the upper frame structure, with the lower track mounted on the lower frame structure to be shiftable vertically with the lower frame structure;

wherein the lower track is configured to engage the panel structure in a condition to guide the panel structure along the lower track simultaneously with movement along the upper track, and to remain in the engaged condition when being shifted with the lower frame structure vertically relative to the panel structure throughout the range of selectable position;

wherein the panel structure has an upper section configured to depend from the upper track and a lower section configured to engage the lower track at a location spaced horizontally from the upper section when the upper section is vertical.

6. An apparatus as defined in claim 5 further comprising product display hooks projecting from the lower frame structure.

7. An apparatus as defined in claim 6 wherein the product display hooks are configured to project past the panel structure.

8. An apparatus as defined in claim 5 further comprising a support structure configured to retain the lower frame structure releasably in each of the selectable positions.

9. An apparatus as defined in claim 8 wherein the support structure includes a pair of gondola uprights.

10. An apparatus as defined in claim 5 wherein the panel structure has a transparent viewing section.

11. An apparatus comprising:

a horizontal upper track;

a panel structure linked to the upper track for movement along the upper track;

a horizontal lower track configured to be shifted relative to the panel structure throughout a vertical range of selectable positions in which the lower track engages the panel structure in a condition to guide the panel structure along the lower track simultaneously with movement along the upper track; and a support structure configured to releasably retain the lower track in each of the selectable positions;

wherein the lower track defines a slot through which the panel structure extends vertically, and along which the panel structure is movable horizontally, when the lower track is in the engaged condition.

12. An apparatus as defined in claim 11 wherein the panel structure is freely movable relative to the lower track vertically into and out of the slot upon movement of the lower track into and out of the engaged condition.

13. An apparatus as defined in claim 11 wherein the lower track has a pair of rails that are spaced apart to define the slot between the rails.

14. An apparatus as defined in claim 13 wherein the panel structure has a transparent viewing section.

* * * * *